US006374544B1

(12) United States Patent
Ellis

(10) Patent No.: US 6,374,544 B1
(45) Date of Patent: Apr. 23, 2002

(54) WINDOW ACTUATOR FOR CASEMENT TYPE WINDOW

(76) Inventor: Frederick Ellis, 80 Burnett Ave., Winnipeg, Manitoba (CA), R2G 1C1

( * ) Notice: Subject to any disclaimer, the term of this patent is extended or adjusted under 35 U.S.C. 154(b) by 0 days.

(21) Appl. No.: 09/664,220

(22) Filed: Sep. 18, 2000

(51) Int. Cl.[7] ..... E05D 15/28
(52) U.S. Cl. ..... 49/249; 49/246; 49/341
(58) Field of Search ..... 49/246, 248, 249, 49/250, 251, 252, 339, 341, 342, 345, 346

(56) References Cited

U.S. PATENT DOCUMENTS

| | | | | |
|---|---|---|---|---|
| 4,037,483 A | | 7/1977 | Nadal | |
| 4,241,541 A | | 12/1980 | Van Klompenburg et al. | |
| 4,253,276 A | | 3/1981 | Peterson et al. | |
| 4,301,622 A | | 11/1981 | Dunsmoor | |
| 4,305,228 A | | 12/1981 | Nelson | |
| 4,445,794 A | * | 5/1984 | Sandberg | 384/428 |
| 4,505,601 A | | 3/1985 | Sandberg et al. | |
| 4,840,075 A | | 6/1989 | Tucker | |
| 4,860,493 A | * | 8/1989 | Lense | 49/279 |
| 4,887,392 A | * | 12/1989 | Lense | 49/300 |
| 4,938,086 A | | 7/1990 | Nolte et al. | |
| 4,945,679 A | | 8/1990 | Aumercier | |
| 5,054,239 A | | 10/1991 | Tucker et al. | |
| 5,440,839 A | | 8/1995 | Piltingsrud | |
| 5,450,654 A | * | 9/1995 | Sullivan | 16/370 |
| 5,493,813 A | | 2/1996 | Vettter et al. | |
| 5,531,138 A | | 7/1996 | Vetter | |
| 5,623,784 A | | 4/1997 | Kuersten et al. | |
| 5,765,308 A | | 6/1998 | Anderson et al. | |
| 5,802,913 A | | 9/1998 | Winner | |
| 5,815,984 A | * | 10/1998 | Sheets et al. | 49/246 |
| 5,839,229 A | * | 11/1998 | Briggs et al. | 149/246 |
| 5,937,582 A | * | 8/1999 | Taylor | 49/341 |
| 6,128,858 A | * | 10/2000 | Vetter et al. | 49/342 |
| 6,247,270 B1 | * | 6/2001 | Numl | 49/341 |

FOREIGN PATENT DOCUMENTS

| | | |
|---|---|---|
| EP | 297419 | 6/1988 |
| EP | 419687 | 9/1989 |

OTHER PUBLICATIONS

Brochure—by Truth Hardware (4 pages).

* cited by examiner

*Primary Examiner*—Jerry Redman
(74) *Attorney, Agent, or Firm*—Adrian D. Battison; Michael R. Williams

(57) ABSTRACT

A window actuator for a casement window has an actuator housing having a generally channel shaped receptacle portion defined by a rear wall, a front wall generally parallel to the front wall, and two end walls spaced to form therebetween a hollow interior with an open top surrounded by an outwardly extending peripheral flange and a base plate extending from the rear wall beyond the open top for mounting on a window frame. A worm housing is connected to and extends outwardly from the front wall of the housing and holds, by a plastics locking member threaded into the worm housing, a worm which is rotated by a manually actuable crank to drive a rotatable wheel mounted within the hollow interior. The wheel has an outwardly extending portion connected by an arcuate pivotal link to an actuator arm pivoted at its inner end on the base plate and arranged so that in the extended position of the arm, the link goes overcenter against a stop on the housing. The wheel is mounted on a mounting pin by an integral plastics bearing member including an annular sleeve portion projecting through the opening and having an inner surface surrounding the pin and an outer surface engaging the opening in the wheel, a planar plate portion lying between and in contact with one side surface of the wheel and one of the front and rear walls and a locating portion for engaging the wheel to prevent relative rotation between the wheel and the bearing member.

19 Claims, 6 Drawing Sheets

WINDOW ACTUATOR FOR CASEMENT TYPE WINDOW

BACKGROUND OF THE INVENTION

One component of window hardware which is necessary for mounting and operating casement type windows is an actuator which operates to pivot the window about its hinges from a retracted or closed position to an extended position generally at right angles to the window frame.

In general the window actuator comprises a housing or base member which is mounted on the window frame, a manually operable hand crank which rotates a worm supported in the housing and a wheel member which is driven by the worm to operate movement of an arm with an outer engagement portion at the end of the arm for sliding or running within a guide track mounted on the window.

Examples of devices of this type are shown in the following patents.

U.S. Pat. No. 5,802,913 (Winner) issued Sep. 8, 1998—U.S. Pat. No. 5,765,308 (Anderson et al) issued Jun. 16, 1998—U.S. Pat. No. 5,623,784 (Kuersten et al) issued Apr. 29, 1997—U.S. Pat. No. 5,531,138 (Vetter) issued Jul. 2, 1996—U.S. Pat. No. 5,493,813 (Vetter et al) issued Feb. 27, 1996—U.S. Pat. No. 5,440,839 (Piltingsrud) issued Aug. 15, 1995—U.S. Pat. No. 5,054,239 (Tucker et al) issued Oct. 8, 1991—U.S. Pat. No. 4,938,086 (Nolte et al) issued Jul. 3, 1990 U.S. Pat. No. 4,945,679 (Aumercier) issued Aug. 7, 1990—U.S. Pat. No. 4,840,075 (Tucker) issued Jun. 20, 1989—U.S. Pat. No. 4,505,601 (Sandberg et al) issued Mar. 19, 1985—U.S. Pat. No. 4,305,228 (Nelson) issued Dec. 15, 1981—U.S. Pat. No. 4,301,622 (Dunsmoor) issued Nov. 24, 1981—U.S. Pat. No. 4,253,276 (Peterson et al) issued Mar. 3, 1981—U.S. Pat. No. 4,241,541 (Van Klompenburg et al) issued Dec. 30, 1980—U.S. Pat. No. 4,037,483 (Nadal) issued Jul. 26, 1977.

Also EP 297,419 (Mila Beslag A/S) and EP 419,687 (Mila Beslag A/S).

Another example is a product manufactured by Mila (identified above) in which the wheel does not directly carry the arm itself but instead operates a link which pushes on the arm with the inner end of the arm being pivotal on the housing.

While the above patents have led to commercial devices which are generally satisfactory, these have a number of points which could be improved and disadvantages which could be overcome.

SUMMARY OF THE INVENTION

It is one object of the present invention to provide an improved window actuator.

According to one aspect of the invention there is provided an window actuator for a casement window comprising:

an actuator housing having a generally channel shaped receptacle portion defined by a rear wall, a front wall generally parallel to the front wall, and two end walls spaced to form therebetween a hollow interior with an open top and a base plate extending from the rear wall beyond the open top for mounting on a window frame;

a worm housing connected to and extending outwardly from the front wall;

a worm mounted in the worm housing for rotation about an axis longitudinal of the worm housing with a gear portion of the worm projecting into the hollow interior;

a manually actuable crank attached to an outer end of the worm for driving rotation of the worm;

a rotatable wheel mounted within the hollow interior for rotation about an axis transverse to the front and rear walls such that a peripheral edge of the wheel engages the gear portion such that rotation of the worm causes rotation of the wheel about its axis;

an actuator arm extending from the actuator housing to an outer end carrying an operator abutment for engaging a slide track carried on the window, the actuator arm being arranged such that rotation of the wheel in one direction causes movement of the actuator arm from a retracted position lying alongside the actuator housing to an extended position projecting outwardly from the actuator housing for opening the window and rotation of the wheel in an opposed direction causes movement of the actuator arm from the extended position to the retracted position for closing the window;

a mounting pin for supporting the wheel extending between the front and rear walls across the hollow interior and extending through an opening in the wheel;

and an integral plastics bearing member for mounting the wheel on the pin for rotation of the wheel about a longitudinal axis of the pin including an annular sleeve portion projecting through the opening and having an inner surface surrounding the pin and an outer surface engaging the opening in the wheel, a planar plate portion lying between and in contact with one side surface of the wheel and one of the front and rear walls and a locating portion for engaging the wheel to prevent relative rotation between the wheel and the bearing member.

Preferably the locating portion comprises a pin extending from the plate portion into a hole in the wheel.

Preferably the sleeve portion extends to an end face standing slightly proud of the opposite side surface of the wheel.

Preferably the actuator arm has an inner end pivotally mounted on the actuator housing and wherein there is provided a pivotal link extending between the wheel and the arm for effecting pivotal movement of the arm relative to the actuator housing between the retracted and extended positions.

Preferably the wheel includes an actuating portion extending outwardly from the axis of the wheel with the portion being pivotally connected to the link and the link being pivotally connected to the arm at a position thereon spaced outwardly from the inner end of the arm.

Preferably the link is arranged to go overcenter when the arm is in a fully extended position and wherein there is provided a stop member on the housing for locating the link in the overcenter position such that forces on the window tending to move the window in a closing direction from the fully extended position are resisted by the stop member.

Preferably the stop member is provided on the rear wall and is arranged to engage the link at a position between the actuating portion of the wheel and the rear wall.

Preferably the pivotal connection between the actuating portion of the wheel and the link is moved in the retracted position to a location within the hollow interior and the link is arcuate.

Preferably the arm is pivoted on a tab portion at one end of the base plate.

Preferably the actuator housing includes a planar end face at right angles to the front and rear walls at a top of the front and rear walls defined by a flange having a flange portion projecting rearwardly from the rear wall and the base plate.

Preferably the flange includes a flange portion projecting forwardly from the front wall.

Preferably the flange includes a flange portion projecting outwardly from each of the end walls, each flange portion at the respective end wall including a screw hole therethrough.

Preferably the worm includes a plastics locator member thereon engaged into a female threaded opening at an outer end of the worm housing, the plastics locator member having a male locking thread thereon engaged into the female threaded opening to prevent the locator member from being removed as the worm rotates.

Preferably the plastics locator member includes at least two recesses in an outer face by which the plastics locator member is driven into the female threaded opening.

According to a second aspect of the invention there is provided a window actuator for a casement window comprising:

an actuator housing having a generally channel shaped receptacle portion defined by a rear wall, a front wall generally parallel to the front wall, and two end walls spaced to form therebetween a hollow interior with an open top and a base plate extending from the rear wall beyond the open top for mounting on a window frame;

a worm housing connected to and extending outwardly from the front wall;

a worm mounted in the worm housing for rotation about an axis longitudinal of the worm housing with a gear portion of the worm projecting into the hollow interior;

a manually actuable crank attached to an outer end of the worm for driving rotation of the worm;

a rotatable wheel mounted within the hollow interior for rotation about an axis transverse to the front and rear walls such that a peripheral edge of the wheel engages the gear portion such that rotation of the worm causes rotation of the wheel about its axis;

an actuator arm extending from the actuator housing to an outer end carrying an operator abutment for engaging a slide track carried on the window, the actuator arm being arranged such that rotation of the wheel in one direction causes movement of the actuator arm from a retracted position lying alongside the actuator housing to an extended position projecting outwardly from the actuator housing for opening the window and rotation of the wheel in an opposed direction causes movement of the actuator arm from the extended position to the retracted position for closing the window;

wherein the wheel includes an actuating portion extending outwardly from the axis of the wheel with the portion being pivotally connected to the link and the link being pivotally connected to the arm at a position thereon spaced outwardly from the inner end of the arm;

wherein the link is arranged to go overcenter when the arm is in a fully extended position;

and wherein there is provided a stop member on the housing for locating the link in the overcenter position such that forces on the window tending to move the window in a closing direction from the fully extended position are resisted by the stop member.

According to a third aspect of the invention there is provided a window actuator for a casement window comprising:

an actuator housing having a generally channel shaped receptacle portion defined by a rear wall, a front wall generally parallel to the front wall, and two end walls spaced to form therebetween a hollow interior with an open top and a base plate extending from the rear wall beyond the open top for mounting on a window frame;

a worm housing connected to and extending outwardly from the front wall;

a worm mounted in the worm housing for rotation about an axis longitudinal of the worm housing with a gear portion of the worm projecting into the hollow interior;

a manually actuable crank attached to an outer end of the worm for driving rotation of the worm;

a rotatable wheel mounted within the hollow interior for rotation about an axis transverse to the front and rear walls such that a peripheral edge of the wheel engages the gear portion such that rotation of the worm causes rotation of the wheel about its axis;

an actuator arm extending from the actuator housing to an outer end carrying an operator abutment for engaging a slide track carried on the window, the actuator arm being arranged such that rotation of the wheel in one direction causes movement of the actuator arm from a retracted position lying alongside the actuator housing to an extended position projecting outwardly from the actuator housing for opening the window and rotation of the wheel in an opposed direction causes movement of the actuator arm from the extended position to the retracted position for closing the window;

wherein the actuator housing includes a planar end face at right angles to the front and rear walls at a top of the front and rear walls defined by a flange having a flange portion projecting rearwardly from the rear wall and the base plate.

According to a fourth aspect of the invention there is provided a window actuator for a casement window comprising:

an actuator housing having a generally channel shaped receptacle portion defined by a rear wall, a front wall generally parallel to the front wall, and two end walls spaced to form therebetween a hollow interior with an open top and a base plate extending from the rear wall beyond the open top for mounting on a window frame;

a worm housing connected to and extending outwardly from the front wall;

a worm mounted in the worm housing for rotation about an axis longitudinal of the worm housing with a gear portion of the worm projecting into the hollow interior;

a manually actuable crank attached to an outer end of the worm for driving rotation of the worm;

a rotatable wheel mounted within the hollow interior for rotation about an axis transverse to the front and rear walls such that a peripheral edge of the wheel engages the gear portion such that rotation of the worm causes rotation of the wheel about its axis;

an actuator arm extending from the actuator housing to an outer end carrying an operator abutment for engaging a slide track carried on the window, the actuator arm being arranged such that rotation of the wheel in one direction causes movement of the actuator arm from a retracted position lying alongside the actuator housing to an extended position projecting outwardly from the actuator housing for opening the window and rotation of the wheel in an opposed direction causes movement of the actuator arm from the extended position to the retracted position for closing the window;

wherein the worm includes a plastics locator member thereon engaged into a female threaded opening at an outer end of the worm housing, the plastics locator member having a male locking thread thereon engaged into the female threaded opening with the male locking thread arranged to prevent the locator member from being removed as the worm rotates.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
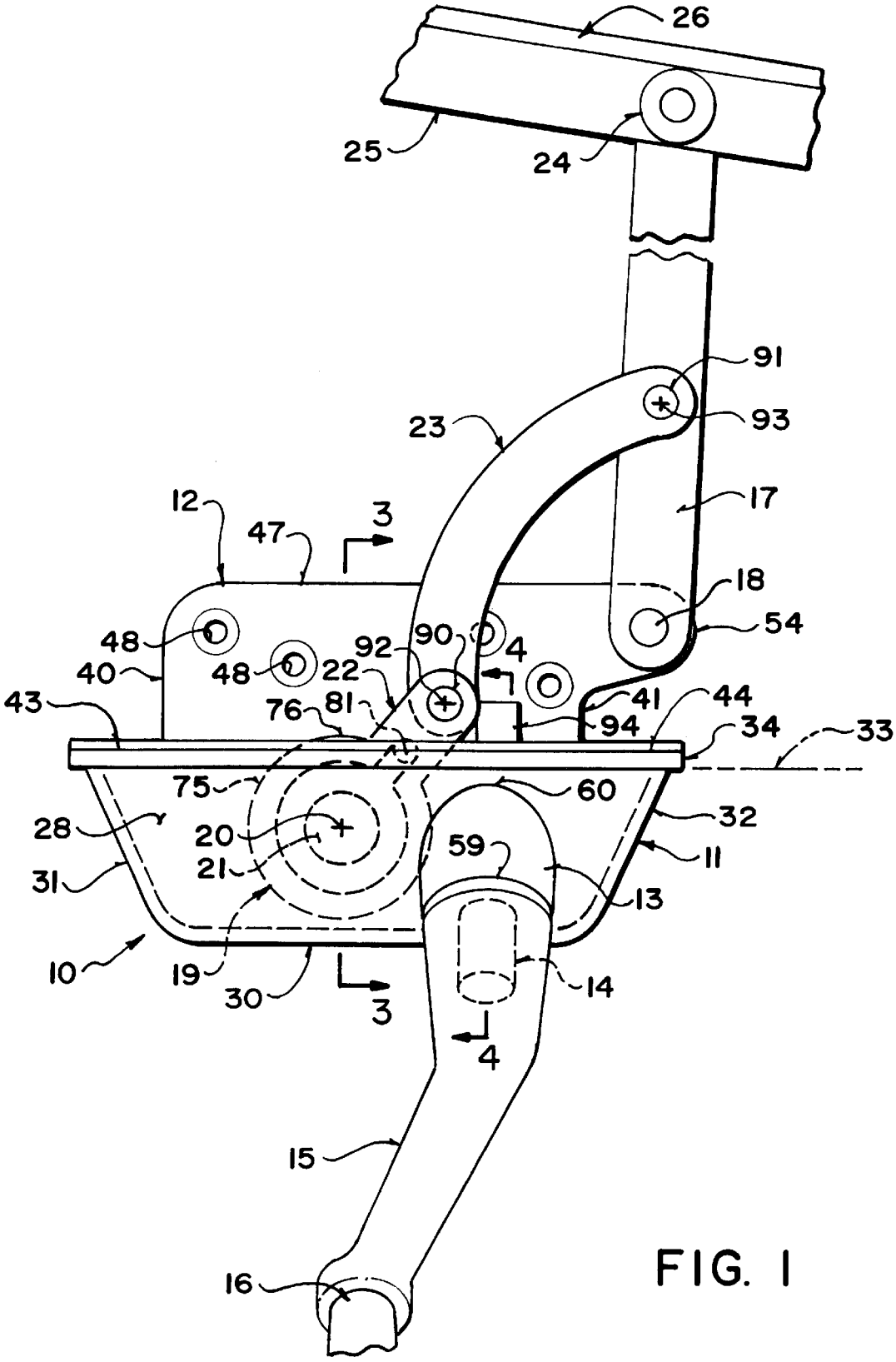
FIG. 1 is a front elevational view of a window actuator according to the present invention showing the window in a partly open position.

The actuator comprises a housing 10 including a receptacle portion 11 and a base plate 12. On the receptacle portion 11 is mounted a worm housing 13 to receive a worm 14 which is rotatable by a manually operable hand crank 15 with a handle 16 at its outer end. A pivotal arm 17 is mounted on a pivot pin 18 attached to one end of the base plate 12. A wheel 19 is driven by the worm 14 so that it rotates about the axis 20 of a mounting pin 21 so as to drive a projecting portion 22 of the wheel to effect movement of a pivotal link 23 which drives the arm between a retracted position shown in FIG. 5 and an extended position shown in FIG. 1. At the outer end of the arm 17 is mounted a roller 24 which slides within a track 25 attached to the window frame shown only schematically at 26. The receptacle portion 11 of the housing includes a front wall 28 and a rear wall 27 which are generally parallel and are spaced so as to define a hollow interior 29 therebetween. The base of the receptacle at the bottom of the front and rear walls is closed by a bottom wall 30. The receptacle also includes end walls 31 and 32 which are formed in effect as a continuation of the base wall with a curvature at the junctions therebetween so as to provide a smooth attractive appearance of the housing with the base wall being slightly narrower and shorter than a top edge of the receptacle portion at the top of the front wall, rear wall and end walls.

Figure 3:
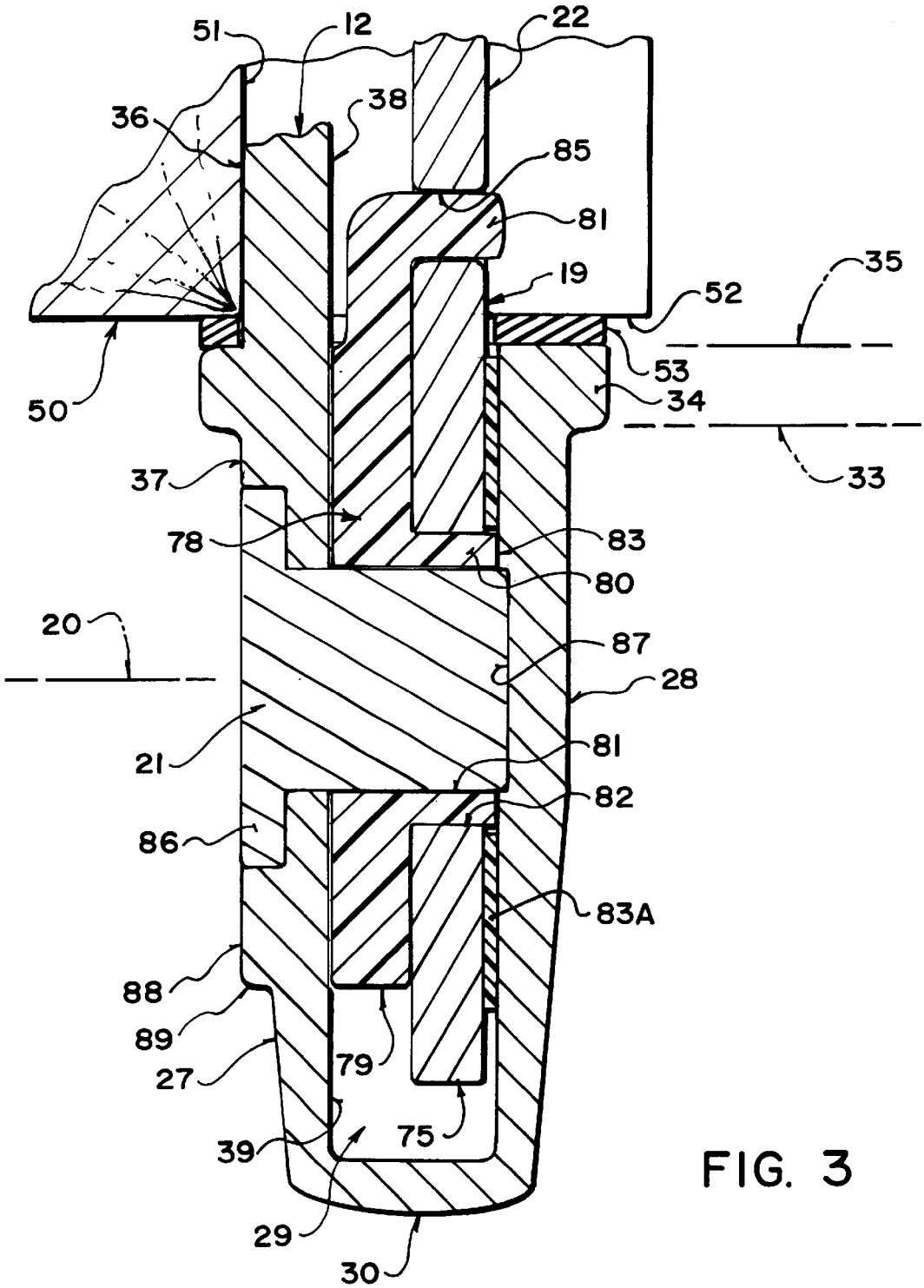
FIG. 3 is a cross sectional view along the lines 3—3 of FIG. 1.
Figure 4:
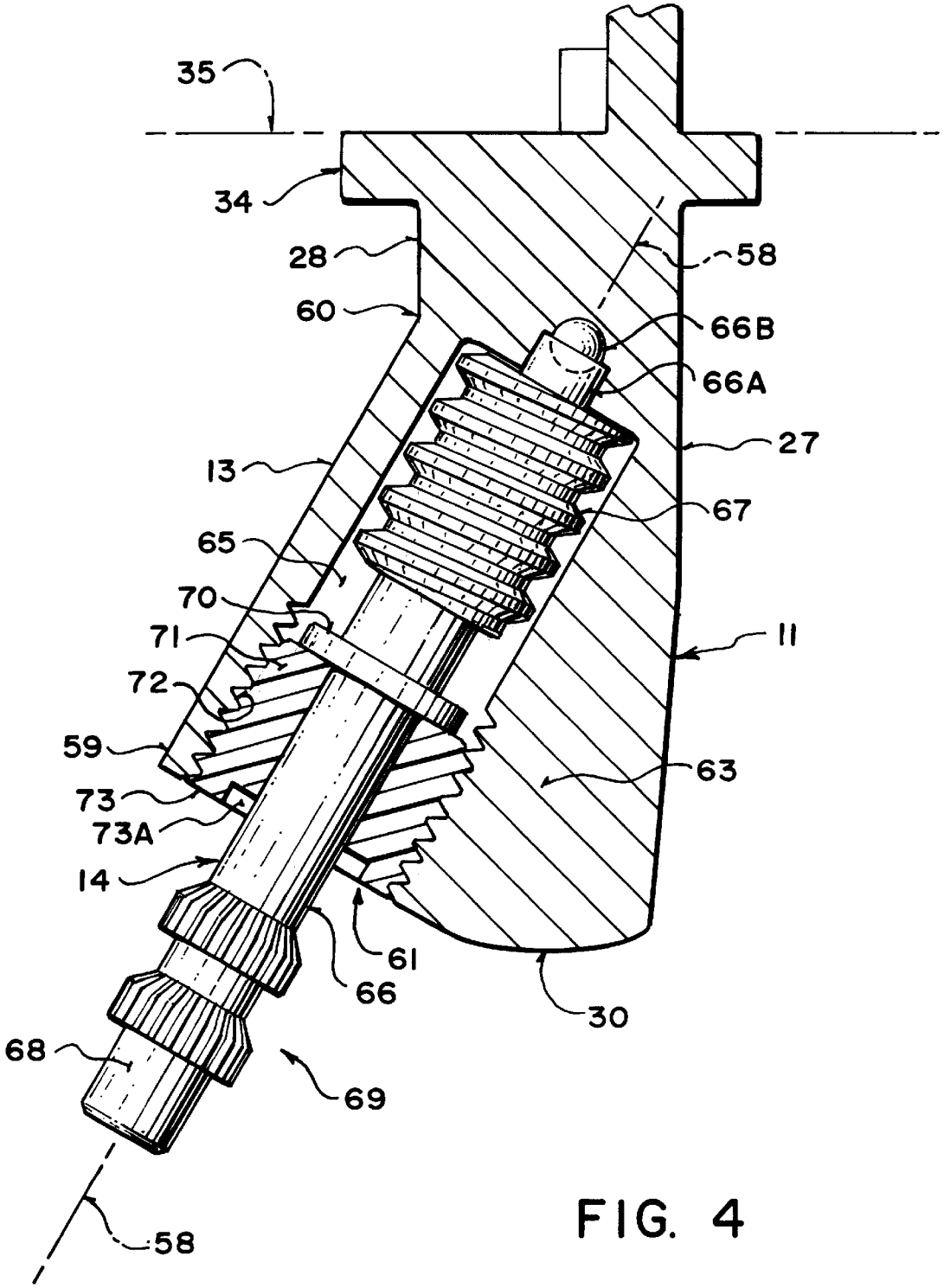
FIG. 4 is a cross sectional view along the lines 4—4 of FIG. 1 with the handle removed.

The top edges of the walls are aligned so as to form a top plane 33 at which is located a surrounding flange 34 which is relatively shallow in comparison with the depth of the walls and simply in effect forms a bead raised from each of the walls so as to project outwardly from each of the walls both at the ends and from both the front and rear walls as best shown in FIG. 3. The top surface of the flange 34 lies in a common plane 35 parallel to the plane 33.

Figure 2:
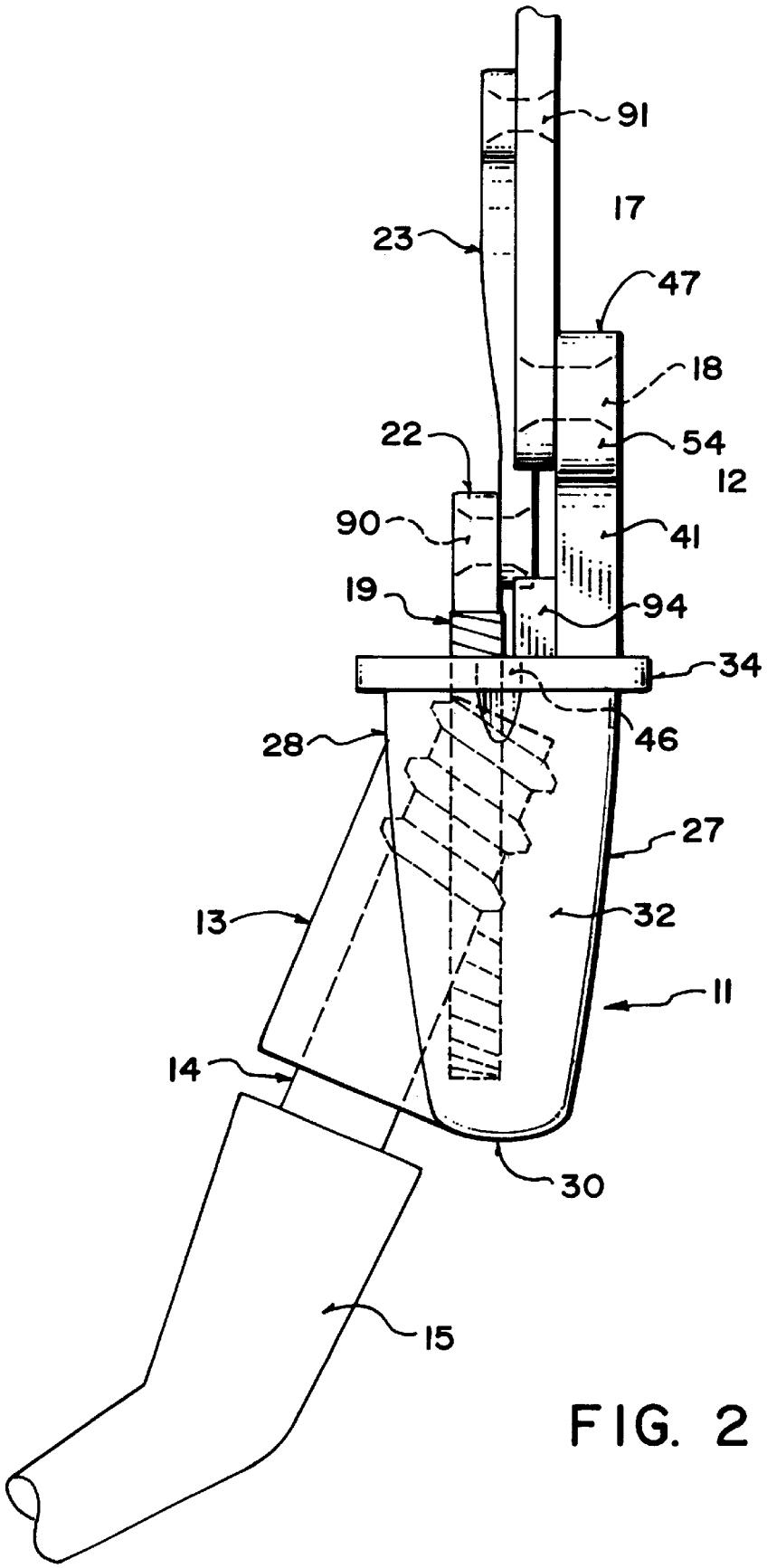
FIG. 2 is an end elevational view of the actuator of FIG. 1 showing part of the internal operating elements in phantom.

The base plate 12 is formed in effect as a continuation of the rear wall 27 so that it has an outer surface 36 coplanar with an outer surface 37 of the rear wall 27 and an inner surface 38 coplanar with an inner surface 39 of the rear wall 27. The base plate has end edges 40 and 41 which are recessed inwardly from the corresponding end walls 31 and 32 so that an end portion 43 and 44 of the receptacle portion 11 is exposed beyond the base plate 12. A screw hole 45, 46 is drilled through each of the end portions so as to pass through the flange 34 and partly through the end wall 31, 32 so as to define the channel cut partly into the end wall as best shown in FIG. 2. The base plate 12 has a top edge 47 which is parallel to the plane 35 of the flange. The base plate 12 has a plurality of mounting holes 48 through the base plate which are chamfered on the front side so as to receive screws allowing the base plate to be screwed down onto the window frame. The holes are arranged in a random or offset pattern so that there is less tendency to split the window frame by applying pressure from aligned screws.

The window frame is shown schematically in FIG. 3 and indicated at 50 where a channel or slot is cut in the window frame for receiving the base plate and allowing the base plate to be screwed to a bottom surface of the channel or the bottom wall of a vinyl extrusion. The flange 34 then butts up against an end face 52 of the piece in which the channel is formed or against the surrounding edges of the slot in the extrusion and a gasket 53 is provided between the upper surface of the flange and the surface 52 of the frame so as to provide a sealing effect to prevent the penetration of air around the actuator through the channel from the exterior.

The base plate 12 includes a projecting portion 54 which projects from the end 41 to a position adjacent the end wall 32 and spaced upwardly from the flange 34. The projecting portion 54 lies in the same plane as the remainder of the base plate and forms a lug to which the arm 17 is attached by a pivot pin or rivet 18. The arm thus lies against the base plate and can pivot from the retracted position shown in FIG. 5 in which the arm lies along the top edge 47 to the extended position shown in FIG. 1 and FIG. 2 in which the arm projects out at right angles to the top edge 47. In this way forces from the window caused by pulling for example by the wind are primarily transmitted through the arm 17 to the fixed base plate 12 which is securely fastened to the frame. Underneath the lug 54 is the recess defined by the end face 41 which allows the lug to be hooked through the slot in the extrusion with the slot equal in length to the spacing between the end faces 40 and 41.

The worm housing 13 forms a part cylindrical shaped portion which defines an axis 58 lying at an angle to the front wall 28 so that a base part 59 of the worm housing extends outwardly from the front wall 28 and the remainder of the worm housing converges gradually into the front wall 28 at an upper end 60 of the worm housing. The bottom end 59 of the worm housing defines a circular end face 61 which is accessible at the bottom of the worm housing which is adjacent the bottom wall 30 of the receptacle portion 11.

At the worm housing, the receptacle portion includes a filler piece 63 extending across the walls 27 and 28 so as to define a solid interior portion across the hollow interior and dividing the hollow interior into two sections, on either side of the worm housing. This solid interior together with the interior of the worm housing is formed into a chamber 65 which receives the worm 14.

The worm 14 includes a main shaft 66 which has a cylindrical butt portion 66A of reduced diameter at its inner end received into a cylindrical receptacle of the same diameter at the end of the cylinder 65. At the bottom of the butt portion is provided a part spherical recess which matches a similar part spherical recess in the end face of the receptacle. These facing recesses house a ball bearing 66B on which the worm can press and rotate with the ball allowing free rotation and absorbing thrust forces.

Adjacent the butt portion is provided a male threaded section 67 defining an operating portion of the worm for co-operating with the wheel in a conventional worm and wheel action. The remainder of the shaft 67 projects along the cylinder 65 to an end portion projecting beyond the end of the worm housing 13 to define a mounting section 69 for attachment to the manually operable handle 15. The mounting section includes two collars which are serrated to co-operate with similar shaped sections within the end of the crank 15 so that rotation of the crank drives the shaft 66 and therefore rotates the worm portion 67.

The shaft 66 includes a collar 70 which butts against a plastics locking piece 71 engaged into the end of the cylinder 65. The plastics locking piece has an external male thread for co-operation with a female threaded section 72 of the cylinder. The plastics locking piece has an end face 73 which when inserted into place is aligned with the end face of the worm housing and includes four holes 73A parallel to the axis 58 and spaced at 90 degrees apart which can be grasped by a suitable shaped wrench for screwing the locking piece into the threaded section 72.

The locking piece is provided with a flange 71A parallel to the axis 58 and longitudinal of the thread section 71B on its outer surface arranged so that it locks into place by compression and distortion when screwed into the cylinder 65 and thus is prevented from reverse rotation which would allow it to escape or at least loosen so that the worm shaft moves axially. In addition the female threaded section 72 in the worm housing is tapered at 72A so as to decrease in diameter toward the bottom thus acting to clamp around the locking piece and to further distort the flange in the thread. Thus the locking piece locks in place and butts against the collar 70 to hold the worm tight in place butting into the receptacle at the end of the cylinder 65.

The worm is thus held in place by the ball at one end and the plastics locking piece at the other end so as to take up the thrust forces applied by the wheel. In particular, the maximum thrust forces applied in trying to close the window in the fully closed position at the frame are accommodated by the ball and thus those forces can be more effectively applied by the manual cranking action on the worm.

The wheel 19 comprises a flat circular disc 75 with the projecting portion 22 extending from an outer periphery 76 of the disc 75 at one part of the periphery of a width sufficient merely to provide sufficient strength and to accommodate the connection to the link 23. The thickness of the projecting portion is the same as the thickness of the disc. One surface of the disc 75 is adjacent the front face 28. The disc 75 is mounted upon the pin 21 by a bearing member 78. The bearing member 78 includes a generally flat plate portion 79, a sleeve portion 80 and a locating portion 81. The sleeve portion 80 includes a cylindrical inner surface 81 contacting and surrounding the pin 21. The sleeve portion projects through an opening 82 in the disc 75 and extends to a front surface 83 slightly proud of the surface of the disc adjacent the front wall 28 so that the slightly proud front surface 83 contacts the front wall 28 and holds the surface of the disc slightly away from the front wall to reduce friction and wear. Around the proud portion defined by the front surface 83 is provided an annular disk 83A of a thickness substantially equal to the amount of projection which is of the order of 0.02 inch so as to provide an effective bearing surface between the front surface of the wheel and the front wall of the housing without any appreciable spacing therebetween.

The sleeve portion 80 is integrally connected to the plate portion 79 which lies between the rear surface of the disc 75 and the front surface of the rear wall 27. Thus the bearing member provides a bearing surface for rotating against the rear wall 27. The locating portion 81 extends outwardly from the edge of the plate portion 79 and defines a hook shape finger projecting initially radially outwardly of the axis 20 and then turned through a hole 85 in the wheel at the projecting portion 22. Thus the bearing is held so that it rotates always with the wheel to support the wheel against friction and wear relative to the pin and relative to the housing. The portion 79 also acts to hold the required spacing of the wheel from the rear wall.

The pin 21 includes a head 86 which is a friction fit within a recess or counterbore or drilled in the rear face of the rear wall 27. The outside edge of the head is knurled in order to be maintained fixed in place by the friction fit when the pin is pressed into the recess. The rear wall 27 includes a hole which is drilled through the rear wall into the hollow interior so that the pin can project across the hollow interior into a shallow blind bore drilled into the rear surface of the front wall 28. Thus the pin is located by its engagement with the front and rear walls and is held in place by its engagement with the recess at the head 86. The outside face of the pin is flush with the rear surface of the rear wall. In order to provide additional thickness at the head 86, a raised portion 88 of the rear wall projects slightly outwardly from the rear surface of the rear wall and downwardly from the flange 34 to a curved bottom edge 89 of the projection.

The link 23 is arcuate and extends from a rivet 90 connecting the link to the projecting portion 22 to a second rivet connecting the link to the arm 17. The rivets have heads which are flush with the surfaces of the relative component. The rivet 90 defines a pivot axis 92 and the rivet 91 defines a pivot axis 93. The pivot axes 91, 92 and 20 are parallel. In the extended position shown in FIG. 1, the pivot axis 92 moves to a side of a line joining the pivot axes 91 and 20 which is over-center that is beyond that line so that the pressure on the link caused by fluttering of the window when open tends to push the link and the axis 92 further over-center. The end of the link at the rivet 90 in its position butts a stop member 94 which is formed on the front face of the base plate 12 and stands up from the flange 34 to a position just to engage the end of the link in this over-center fully extended position. It will be noted from FIG. 2 that the link is mounted on the rear side of the wheel so that it commences at a position overlying the plate portion of the bearing and the link is slightly curved so it extends to a position on the front side of the arm 17.

Figure 5:
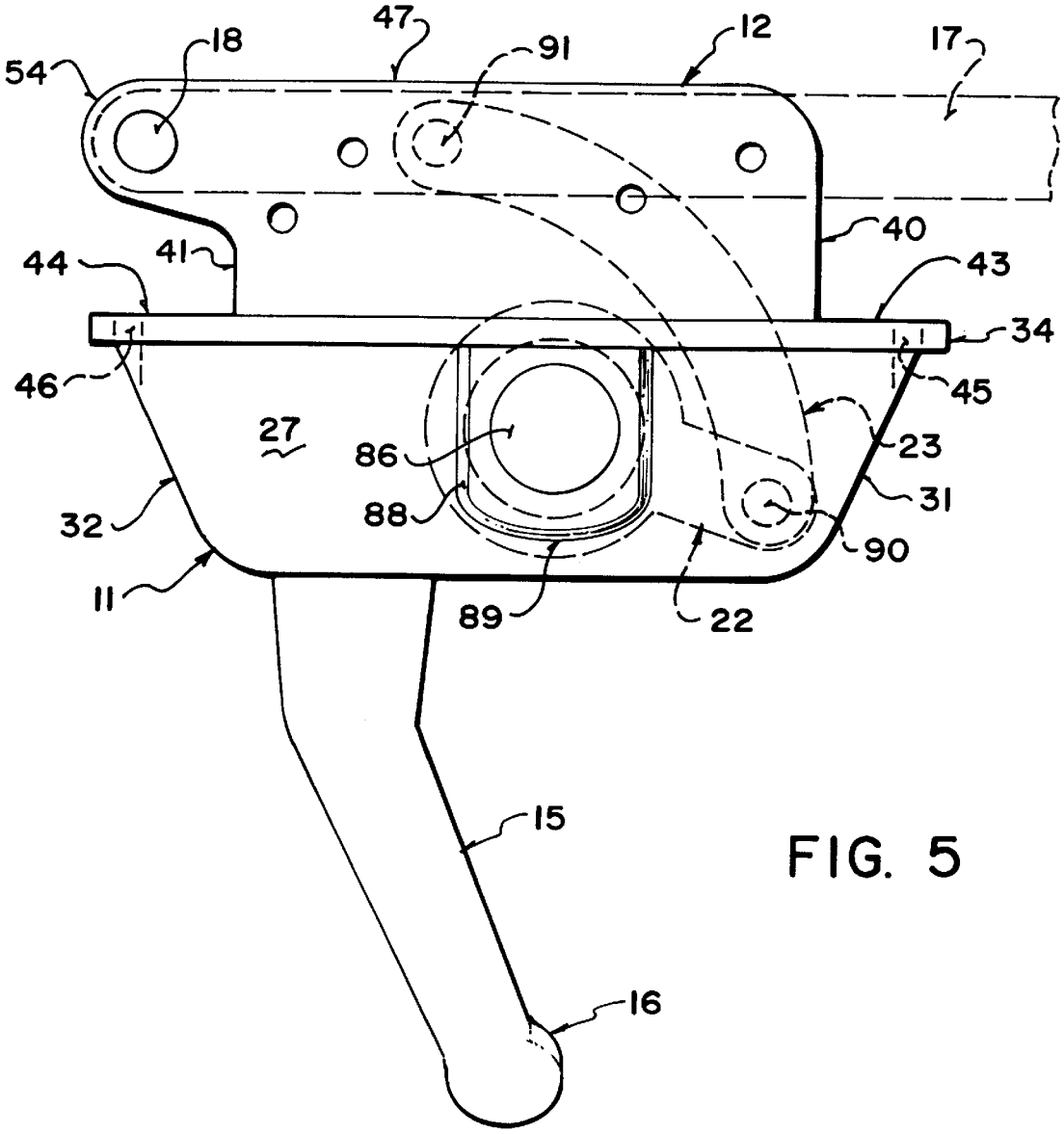
FIG. 5 is a rear elevational view of the actuator of FIG. 1 showing part of the internal operating elements in phantom.
Figure 6:
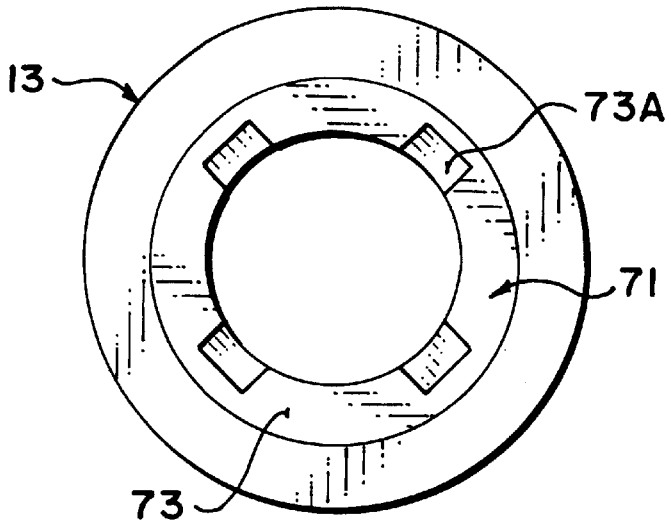
FIG. 6 is an end elevational view of the worm, plastics locking piece and worm housing of FIG. 4.
Figure 7:
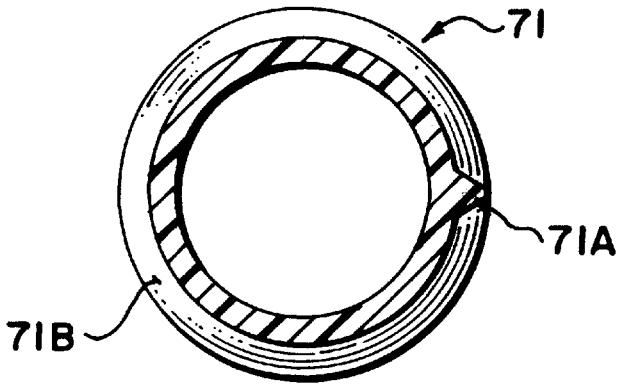
FIG. 7 is a transverse cross sectional view of the plastics locking piece of FIG. 4.
Figure 8:
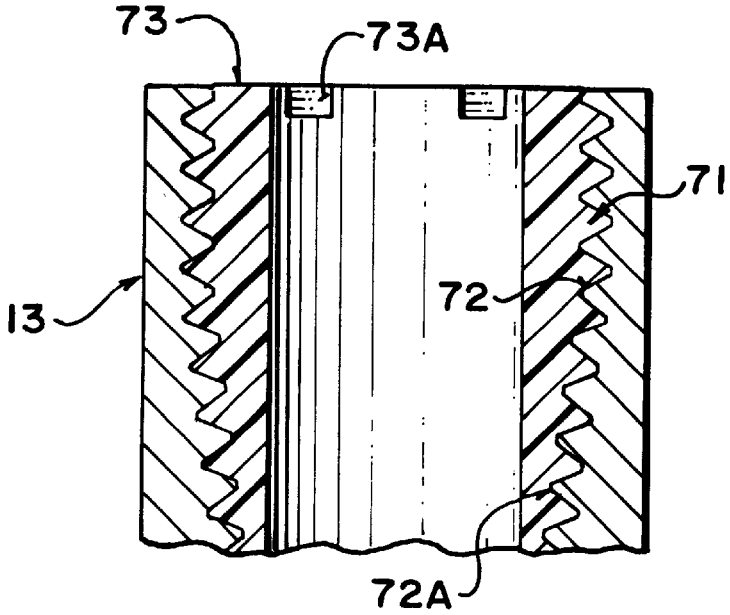
FIG. 8 is a transverse cross sectional view of the worm, plastics locking piece and worm housing of FIG. 4.

In the position shown in FIG. 5, the projecting portion 22 is moved to a position in which it is at the base of the housing adjacent the bottom wall 30 after rotation through an angle of the order of 120°. The link then extends arcuately over the main body of the wheel to the rivet 91 located on the arm at a position on the arm partway along the base plate 12. Thus the projecting portion and the link are carried through the open mouth of the hollow interior into the hollow interior in a retracted position.

The housing including the front wall, rear wall and the base plate are formed integrally from die cast metal or similar material so as to form a rigid housing of attractive appearance. There are no loose separate parts which need to be assembled and the housing can be finished attractively with a suitable powder coat or similar lacquer material which is hard wearing and long lasting.

The arrangement described above includes a number of advantages relative to prior art arrangements including the smooth operation provided by the arrangement of the link and the arm together with the mounting of the wheel and the mounting of the worm.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A window actuator for a casement window comprising:

an actuator housing having a generally channel shaped receptacle portion defined by a front wall, a rear wall generally parallel to the front wall, and two end walls spaced to form therebetween a hollow interior with an open top and a base plate extending from the rear wall beyond the open top for mounting on a window frame;

a worm housing connected to and extending outwardly from the front wall;

a worm mounted in the worm housing for rotation about an axis longitudinal of the worm housing with a gear portion of the worm projecting into the hollow interior;

a manually actuable crank attached to an outer end of the worm for driving rotation of the worm;

a rotatable wheel mounted within the hollow interior for rotation about an axis transverse to the front and rear walls such that a peripheral edge of the wheel engages the gear portion such that rotation of the worm causes rotation of the wheel about its axis, the wheel including an actuating portion attached thereto;

an actuator arm extending from the actuator housing to an outer end carrying an operator abutment for engaging a slide track carried on the window, the actuator arm being arranged such that rotation of the wheel in one direction causes the actuating portion to effect movement of the actuator arm from a retracted position lying alongside the actuator housing to an extended position projecting outwardly from the actuator housing for opening the window and rotation of the wheel in an opposed direction causes movement of the actuator arm from the extended position to the retracted position for closing the window;

a mounting pin for supporting the wheel extending between the front and rear walls across the hollow interior and extending through an opening in the wheel;

and an integral plastics bearing member for mounting the wheel on the pin for rotation of the wheel about a longitudinal axis of the pin including an annular sleeve portion projecting through the opening and having an inner surface surrounding the pin and an outer surface engaging the opening in the wheel, a planar plate portion lying between and in contact with one side surface of the wheel and one of the front and rear walls and a locating portion for engaging the wheel to prevent relative rotation between the wheel and the bearing member.

2. The window actuator according to claim 1 wherein the locating portion comprises a pin extending from the plate portion into a hole in the wheel.

3. The window actuator according to claim 1 wherein the actuator arm has an inner end pivotally mounted on the actuator housing and wherein there is provided a pivotal link extending between the actuating portion of the wheel and the arm for effecting pivotal movement of the arm relative to the actuator housing between the retracted and extended positions.

4. The window actuator according to claim 3 wherein the actuating portion of the wheel extends outwardly from the axis of the wheel with the actuating portion being pivotally connected to the link and the link being pivotally connected to the arm at a position thereon spaced outwardly from the inner end of the arm.

5. The window actuator according to claim 4 wherein the link is arranged to go overcenter when the arm is in a fully extended position and wherein there is provided a stop member on the housing for locating the link in the overcenter position such that forces on the window tending to move the window in a closing direction from the fully extended position are resisted by the stop member.

6. The window actuator according to claim 5 wherein the stop member is provided on the rear wall and is arranged to engage the link at a position between the actuating portion of the wheel and the rear wall.

7. The window actuator according to claim 4 wherein the pivotal connection between the actuating portion of the wheel and the link is moved in the retracted position to a location within the hollow interior.

8. The window actuator according to claim 4 wherein the link is arcuate.

9. The window actuator according to claim 4 wherein the arm is pivoted on a tab portion at one end of the base plate spaced outwardly from the open top and longitudinally from an end of the base plate to form a hook portion for engaging into a slot in a window frame.

10. The window actuator according to claim 1 wherein the actuator housing includes a planar end face at right angles to the front and rear walls at a top of the front and rear walls defined by a flange fully surrounding the end face and including a rear flange portion projecting rearwardly from the rear wall and the base plate, a front flange portion projecting forwardly from the front wall and end flange portions projecting outwardly from respective end walls.

11. The window actuator according to claim 10 wherein each end flange portion at the respective end wall includes a screw hole therethrough.

12. The window actuator according to claim 1 wherein the worm includes a plastics locator member thereon engaged into a tapered female threaded opening at an outer end of the worm housing, the plastics locator member having a male locking thread thereon engaged into the female threaded opening to prevent the locator member from being removed as the worm rotates.

13. The window actuator according to claim 12 wherein the plastics locator member includes at least two recesses in an outer face by which the plastics locator member is driven into the female threaded opening.

14. A window actuator for a casement window comprising:

an actuator housing having a generally channel shaped receptacle portion defined by a front wall, a rear wall generally parallel to the front wall, and two end walls spaced to form therebetween a hollow interior with an open top and a base plate extending from the rear wall beyond the open top for mounting on a window frame;

a worm housing connected to and extending outwardly from the front wall;

a worm mounted in the worm housing for rotation about an axis longitudinal of the worm housing with a gear portion of the worm projecting into the hollow interior;

a manually actuable crank attached to an outer end of the worm for driving rotation of the worm;

a rotatable wheel mounted within the hollow interior for rotation about an axis transverse to the front and rear walls such that a peripheral edge of the wheel engages the gear portion such that rotation of the worm causes rotation of the wheel about its axis, the wheel including an actuating portion attached thereto;

an actuator arm extending from the actuator housing to an outer end carrying an operator abutment for engaging a slide track carried on the window, the actuator arm being arranged such that rotation of the wheel in one direction causes the actuating portion to effect movement of the actuator arm from a retracted position lying alongside the actuator housing to an extended position projecting outwardly from the actuator housing for opening the window and rotation of the wheel in an opposed direction causes movement of the actuator arm from the extended position to the retracted position for closing the window;

a mounting pin for supporting the wheel extending between the front and rear walls across the hollow interior and extending through an opening in the wheel;

and an integral plastics bearing member for mounting the wheel on the pin for rotation of the wheel about a longitudinal axis of the pin including an annular sleeve portion projecting through the opening and having an inner surface surrounding the pin and an outer surface engaging the opening in the wheel, a planar plate portion lying between and in contact with one side surface of the wheel and one of the front and rear walls and a locating portion for engaging the wheel to prevent relative rotation between the wheel and the bearing member;

wherein the annular sleeve portion extends to an end face projecting beyond an opposite side surface of the wheel which is opposite to said one side surface and an annular bearing disk surrounds the end face of the annular sleeve portion and lies in contact with said opposite side surface.

15. A window actuator for a casement window comprising:

an actuator housing having a generally channel shaped receptacle portion defined by a front wall, a rear wall generally parallel to the front wall, and two end walls spaced to form therebetween a hollow interior with an open top and a base plate extending from the rear wall beyond the open top for mounting on a window frame;

a worm housing connected to and extending outwardly from the front wall;

a worm mounted in the worm housing for rotation about an axis longitudinal of the worm housing with a gear portion of the worm projecting into the hollow interior;

a manually actuable crank attached to an outer end of the worm for driving rotation of the worm;

a rotatable wheel mounted within the hollow interior for rotation about an axis transverse to the front and rear walls such that a peripheral edge of the wheel engages the gear portion such that rotation of the worm causes rotation of the wheel about its axis;

an actuator arm extending from the actuator housing to an outer end carrying an operator abutment for engaging a slide track carried on the window, the actuator arm being arranged such that rotation of the wheel in one direction causes movement of the actuator arm from a retracted position lying alongside the actuator housing to an extended position projecting outwardly from the actuator housing for opening the window and rotation of the wheel in an opposed direction causes movement of the actuator arm from the extended position to the retracted position for closing the window;

wherein the wheel includes an actuating portion extending outwardly from the axis of the wheel with the portion being pivotally connected to the link and the link being pivotally connected to the arm at a position thereon spaced outwardly from the inner end of the arm;

wherein the link is arranged to go overcenter when the arm is in a fully extended position;

and wherein there is provided a stop member on the housing for locating the link in the overcenter position such that forces on the window tending to move the window in a closing direction from the fully extended position are resisted by the stop member.

16. A window actuator for a casement window comprising:

an actuator housing having a generally channel shaped receptacle portion defined by a front wall, a rear wall generally parallel to the front wall, and two end walls spaced to form therebetween a hollow interior with an open top;

the actuator housing including a base plate extending from the rear wall beyond the open top including mounting holes for mounting the actuator housing on a window frame;

a worm housing connected to and extending outwardly from the front wall;

a worm mounted in the worm housing for rotation about an axis longitudinal of the worm housing with a gear portion of the worm projecting into the hollow interior:

a manually actuable crank attached to an outer end of the worm for driving rotation of the worm;

a rotatable wheel mounted within the hollow interior for rotation about an axis transverse to the front and rear walls such that a peripheral edge of the wheel engages the gear portion such that rotation of the worm causes rotation of the wheel about its axis;

an actuator arm extending from the actuator housing to an outer end carrying an operator abutment for engaging a slide track carried on the window, the actuator arm being arranged such that rotation of the wheel in one direction causes movement of the actuator arm from a retracted position lying alongside the actuator housing to an extended position projecting outwardly from the actuator housing for opening the window and rotation of the wheel in an opposed direction causes movement of the actuator arm from the extended position to the retracted position for closing the window;

wherein the open top of the actuator housing includes a flange defining a planar end face at right angles to the front, rear and end walls and at right angles to the base plate;

and wherein said flange of the open top includes a rear flange portion projecting rearwardly from the rear wall and the base plate, a front flange portion projecting forwardly from the front wall and two end flange portions projecting outwardly from respective end walls such that the flange portions define a continuous flange which surrounds the actuator housing.

17. A window actuator for a casement window comprising:

an actuator housing having a generally channel shaped receptacle portion defined by a front wall, a rear wall generally parallel to the front wall, and two end walls spaced to form therebetween a hollow interior with an open top and a base plate extending from the rear wall beyond the open top for mounting on a window frame;

a worm housing connected to and extending outwardly from the front wall;

a worm mounted in the worm housing for rotation about an axis longitudinal of the worm housing with a gear portion of the worm projecting into the hollow interior;

a manually actuable crank attached to an outer end of the worm for driving rotation of the worm;

a rotatable wheel mounted within the hollow interior for rotation about an axis transverse to the front and rear walls such that a peripheral edge of the wheel engages the gear portion such that rotation of the worm causes rotation of the wheel about its axis;

an actuator arm extending from the actuator housing to an outer end carrying an operator abutment for engaging a slide track carried on the window, the actuator arm being arranged such that rotation of the wheel in one direction causes movement of the actuator arm from a retracted position lying alongside the actuator housing to an extended position projecting outwardly from the actuator housing for opening the window and rotation of the wheel in an opposed direction causes movement of the actuator arm from the extended position to the retracted position for closing the window;

wherein the worm includes a plastics locator member thereon engaged into a female threaded opening at an outer end of the worm housing, the plastics locator member having a male locking thread thereon engaged into the female threaded opening;

wherein the female threaded opening is tapered so as to reduce in diameter in a direction into the worm housing to form a locking action with a locking portion of the male locking thread to prevent the locator member from being removed as the worm rotates.

18. The window actuator according to claim 17 wherein the male locking thread includes a longitudinal flange transversely to the thread so as to be distorted as the male locking thread is inserted into the female threaded opening.

19. A window actuator for a casement window comprising:

an actuator housing having a generally channel shaped receptacle portion defined by a front wall, a rear wall generally parallel to the front wall, and two end walls spaced to form therebetween a hollow interior with an open top and a base plate extending from the rear wall beyond the open top for mounting on a window frame;

a worm housing connected to and extending outwardly from the front wall;

a worm mounted in the worm housing for rotation about a worm axis longitudinal of the worm housing with a gear portion of the worm projecting into the hollow interior, the worm housing defining a receptacle for the worm fixed to the actuator housing;

a manually actuable crank attached to an outer end of the worm for driving rotation of the worm;

a rotatable wheel mounted within the hollow interior for rotation about an axis transverse to the front and rear walls such that a peripheral edge of the wheel engages the gear portion of the worm such that rotation of the worm within the fixed receptacle of the worm housing causes rotation of the wheel about its axis;

an actuator arm extending from the actuator housing to an outer end carrying an operator abutment for engaging a slide track carried on the window, the actuator arm being arranged such that rotation of the wheel in one direction causes movement of the actuator arm from a retracted position lying alongside the actuator housing to an extended position projecting outwardly from the actuator housing for opening the window and rotation of the wheel in an opposed direction causes movement of the actuator arm from the extended position to the retracted position for closing the window;

wherein the worm includes a part spherical recess at an inner end of the worm opposite to the manually actuable crank at the outer end of the worm and the worm housing includes a part spherical recess at a bottom end of the worm housing at said inner end of the worm;

and wherein there is provided a ball bearing lying on the worm axis and housed partly in the part spherical recess at the bottom end of the worm housing and partly in the part spherical recess at the inner end of the worm for allowing free rotation between the worm and the worm housing and for communicating thrust forces along the worm axis from the worm caused by closing the window to the worm housing and thus to the actuator housing.

* * * * *